United States Patent [19]

Hofer et al.

[11] Patent Number: 4,697,192

[45] Date of Patent: Sep. 29, 1987

[54] TWO ARM PLANAR/CONICAL/HELIX ANTENNA

[75] Inventors: Dean A. Hofer, Richardson; Daniel J. Carlson; Matthew L. Pecak, both of Plano, all of Tex.

[73] Assignee: Texas Instruments Incorporated, Dallas, Tex.

[21] Appl. No.: 723,789

[22] Filed: Apr. 16, 1985

[51] Int. Cl.[4] ..... H01Q 1/36

[52] U.S. Cl. ..... 343/895; 343/708; 343/893

[58] Field of Search ..... 343/895, 705, 708, 893

[56] References Cited

U.S. PATENT DOCUMENTS

| | | | |
|---|---|---|---|
| 3,638,224 | 1/1972 | Bailey et al. | 343/893 X |
| 3,825,933 | 7/1974 | Debski et al. | 343/895 |
| 4,012,744 | 3/1977 | Greiser | 343/895 |
| 4,114,164 | 9/1978 | Greiser | 343/895 |
| 4,163,981 | 8/1979 | Wilson | 343/895 X |
| 4,169,267 | 9/1979 | Wong et al. | 343/895 |
| 4,459,596 | 7/1984 | Flam | 343/895 |

FOREIGN PATENT DOCUMENTS

| | | | |
|---|---|---|---|
| 2362913 | 6/1974 | Fed. Rep. of Germany | 343/895 |
| 1568436 | 5/1980 | United Kingdom . | |
| 1572671 | 7/1980 | United Kingdom . | |
| 2159334 | 11/1985 | United Kingdom | 343/895 |
| 0247361 | 7/1969 | U.S.S.R. | 343/895 |

*Primary Examiner*—Daniel M. Yasich

*Attorney, Agent, or Firm*—Richard K. Robinson; James T. Comfort; Melvin Sharp

[57] ABSTRACT

A broadband two arm planar/conical/helix antenna is disclosed. The antenna radiation element includes a two arm planar spiral antenna section, a two arm conical spiral section connected to the planar spiral section and a four arm helix section connected to the conical spiral section for termination. The antenna element is formed on a fiberglas substrate which contains a molded internal load absorber. A tapered magnetic external load absorber covers the antenna radiation element. The supporting fiberglas substrate is fixed to a balun housing. The balun housing has a centrally disposed, upwardly extending tubular means for passing a feed line to the planar spiral section. The internal load absorber comprises a molded body including a first part of silicone resin having graded layers of carbon and micro balloons for absorbing without reflection back lobe radiation of the planar spiral and to absorb the internal electric fields present owing to the conical spiral and a second part of silicone resin filled with iron powder for improving low level frequency response. The external load absorber is a silicone body filled with iron powder; it has a cylindrical portion of uniform thickness around the helix spiral and a smooth tapered portion around the conical spiral. The external load absorber so shaped coacts with the radiation elements and internal load absorber in reducing the effective diameter of the antenna while maintaining uniform broadband antenna performance.

14 Claims, 5 Drawing Figures

PLANAR SPIRAL ANTENNA

PLANAR/CONICAL/HELIX ANTENNA

TWO ARM PLANAR/CONICAL/HELIX ANTENNA

BACKGROUND OF THE INVENTION

This invention relates to antennas and more particularly to a broadband electrically small hybrid spiral antenna having a unique profile capable of operation in special volume constrained locations.

Many high performance aircraft have utilized forward looking radars for detection and ranging purposes. The antennae for these radars are usually located in the nose of the aircraft (a prime antenna location) where they are nearest to free space and therefor perform best. With many new aircraft designs there isn't room for the necessary antenna systems in the aircraft nose region. The room problem persists even though various innovative techniques have been devised which allow some systems to be collocated in the aircraft nose or even share a common aperture. Nevertheless, design trade off considerations sometimes dictate that a particular system be put in a less desirable location on the aircraft. For some limited applications, aircraft wing leading edges have been considered.

Frequently, however, the thin wing designs of the aircraft present problems for the antenna designer. For example, for broadband systems, the planar spiral is considered the basic antenna element candidate. This type of element performs well when in an optimum location such as an aircraft nose and provided a relatively blunt radome is used. If, however, a planar spiral antenna element is to be placed in the thin wing, the diameter of the antenna element requires that it be placed a considerable distance aft of the wing's leading edge. This location results in internal radome wall reflections which are a chief cause of degraded performance. Further, the materials used in the wing often are such as to degrade microwave transmission properties. Conventional broadband conical spirals have been investigated as a possible solution and have had only limited success.

SUMMARY OF THE INVENTION

Accordingly, it is an object of this invention to provide an antenna element for use in the leading edge of an aircraft wing without degrading radar performance.

Another object of the invention is to provide an antenna element or array of elements of a substantially reduced size while retaining the same lower cut-off frequency of past antenna element designs.

Briefly stated the invention comprises a two arm planar/conical/helix antenna which combines the planar spiral type antenna and conical spiral type antenna with a four arm helical antenna section. The antenna is uniquely loaded with lossy material internally to absorb without reflection the back lobe radiation and to absorb the internal electric fields present owing to the conical spiral and externally to enhance low frequency operation capability.

Other objects and features of the invention will become more readily apparent from the following detailed description when read in conjunction with the accompanying drawings, in which:

DETAILED DESCRIPTION OF THE PREFERRED EMBODIMENTS

Figure 2:
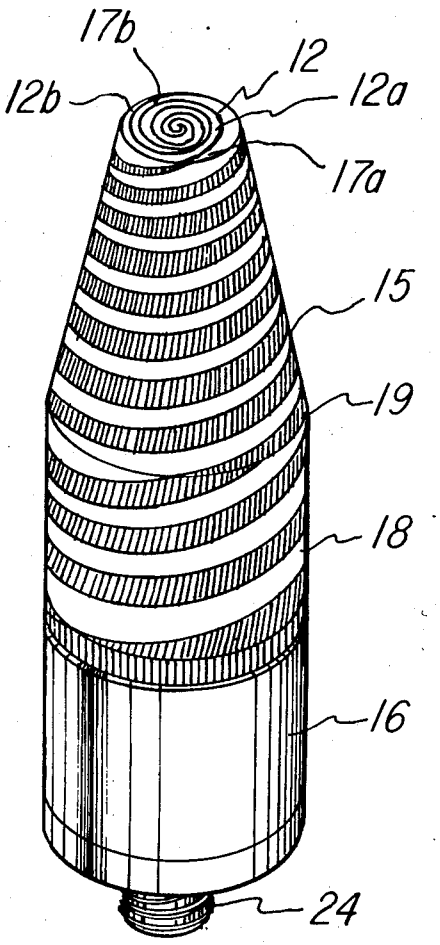
FIG. 2 is a simplified isometric view of the planar/-conical/helix antenna element with the external loading removed.
Figure 1:
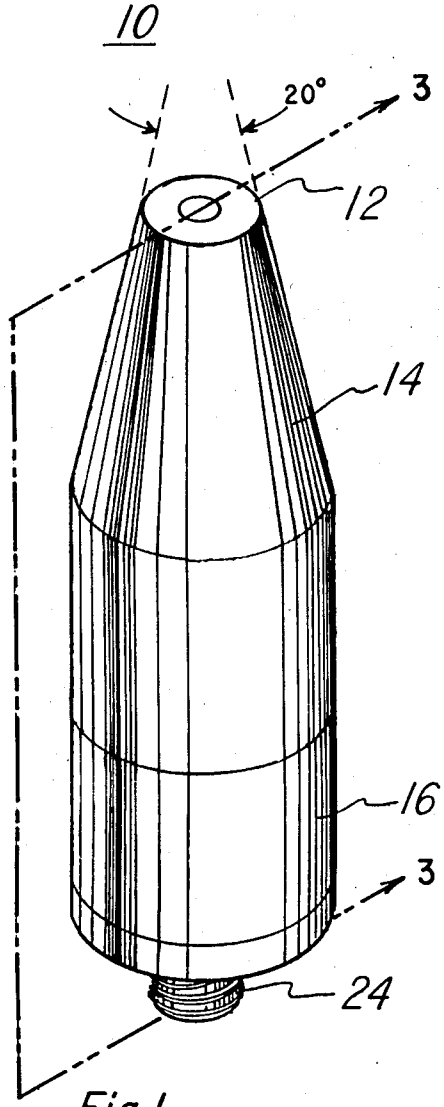
FIG. 1 is an isometric view of the planar/conical/-helix antenna element.

Referring now to FIG. 1, the planar/conical/helix antenna element 10 includes a planar spiral antenna section 12, a tapered external load absorber 14 and a balun housing 16. The planar spiral antenna section 12 is connected to a conical spiral antenna section 15 (FIG. 2) which is connected to a helix spiral antenna section 18. The planar spiral antenna section 12, conical spiral antenna section 15 and helix spiral section 18 combine to form the radiating portion of the antenna element.

The planar spiral antenna section 12 is a two arm 12*a* and 12*b* archimedes planar spiral which feeds the conical spiral antenna section 15 at 17. The conical spiral antenna section 15 is a two arm equiangular spiral having $\alpha=60°$, a sixty degree wrap angle. The two arm equiangular spiral terminates in the helix section 18. The helix antenna antenna section 18 at 19 is a four arm $\frac{3}{4}$ turn helix.

Figure 3:
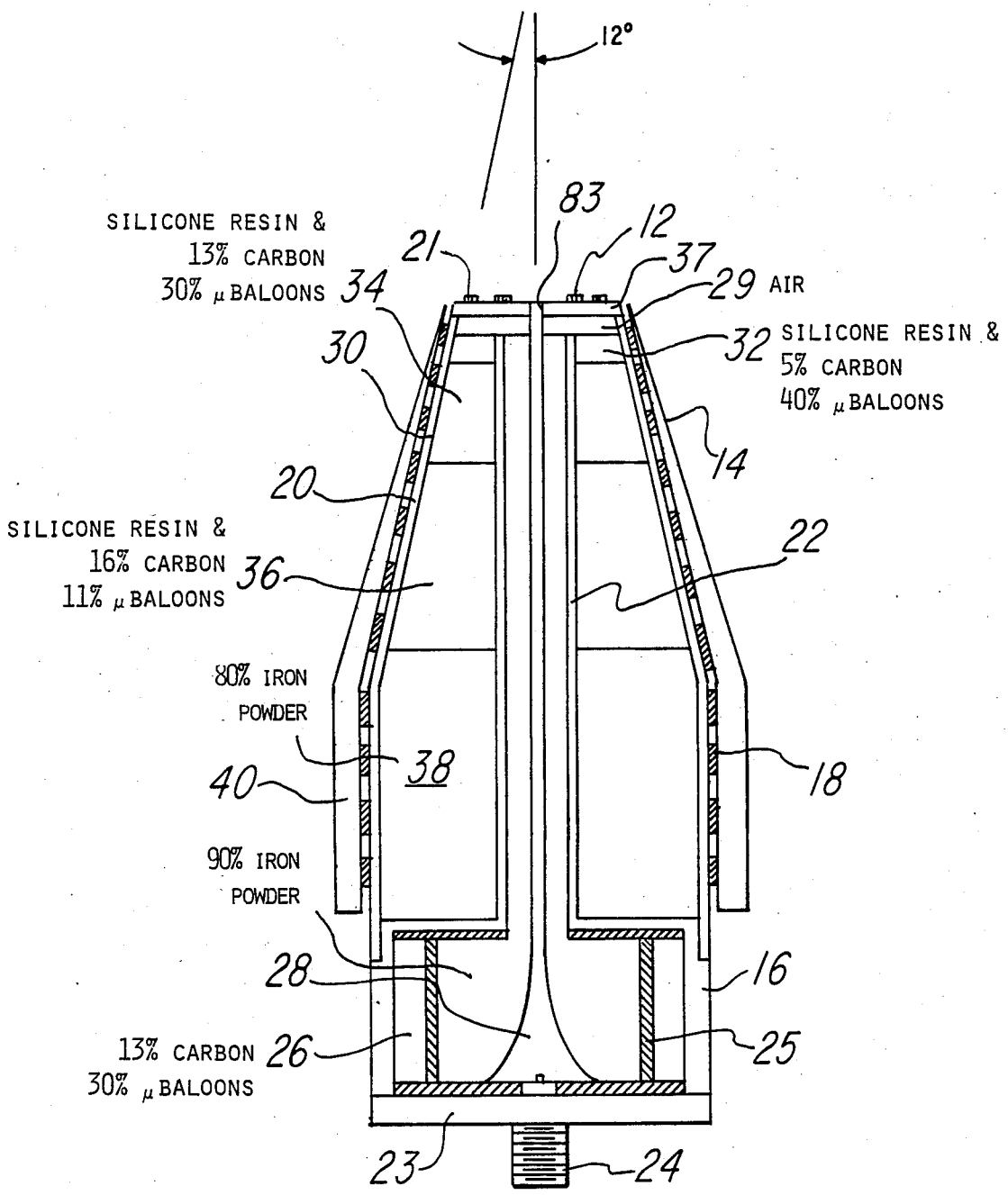
FIG. 3 is a cross-sectional view of the planar/-conical/helix antenna element taken along line III—III of FIG. 1.

Referring now to FIG. 3, the arms 12*a* and 12*b* of the Archimedes planar spiral antenna section 12, conical spiral antenna element section 15 and the helix antenna section 18 are of copper, and etched on a copper clad fiberglas substrate 20 having a truncated conical portion and a cylindrical portion. The apex angle of the truncated conical portion forming a stripline 21 thereby is, for example, that of the wing's leading edge, e.g. about 24 degrees. The substrate copper clad fiberglas 20 is fixed to a balun housing 16.

The balun housing 16 has a hollow base structure which has a centrally disposed upwardly extending tube like member 22 in open communication therewith. The hollow base like portion of the balun housing is partially lined with a flange shaped load absorber 25 of a preselected lossy material such as, for example, a silicone resin filled with 90% by weight iron powder sold by Emerson and Cumming under the trademark LS 90. The area 26 between the outside flanges is filled with a load absorber material such as, for example, a silicone resin filled with 13% carbon and 30% by weight micro balloons.

A printed circuit exponential microstrip balun 28 passes through the balun housing and the cylindrical tube extending into the antenna. Within the hollow portion of the balun housiing the balun is electrically connected to the coaxial (RF input) connecter 24 which may be, for example, an SMA connector. The connector is secured to a metallic balun end cap 23. The upper portion of the balun printed circuit which passes through the tube 22 attaches to the planar spiral antenna RF feed point 83.

The upper boundary of the air space 29 is formed by the under side of the planar spiral fiberglas substrate 37 which is bonded to the fiberglas conical spiral substrate 20. The central tube 22 extends upward to the lower boundary of the airspace 29.

The internal load absorber 30 is a layered molding. The layers of the molding, in order of succession beginning with the portion adjacent to the air space 29 are, for example, a layer 32 of silicone resin filled with 5% by weight carbon and 40% by weight micro balloons sold by Emerson and Cumming under trademark LS 22; a layer 32 of silicone resin filled with 13% carbon and 30% micro balloons sold by Emerson and Cumming under the trademark LS 24; a layer 36 of silicone resin filled with 16% carbon and 11% micro balloons sold by Emmerson and Cumming under the trademark LS 26; and a layer 38, a silicone resin filled with 80% iron powder sold by Emerson and Cumming under the trademark LS 80.

The graded layers 32, 34 and 36 of absorber material become progressively more lossy to absorb without reflection back lobe radiation of the planar spiral and to absorb the internal electric fields present owing to the conical spiral. While the magnetic layer 38, which extends the length of the helix spiral, improves the broadband performance, it was found that rapid gain roll off at the lower frequencies occurred as a result of the restricted base diameter. Thus, the external load absorber 40 was added to the antenna element. The external load absorber comprises, for example, a molded silicone resin filled with 90% iron powder sold by Emerson and Cumming under the trademark LS 90. This external load absorber significantly enhances low frequency performance in terms of radiation patterns and antenna gain.

The absorber 40 is a sleeve having a cylindrical portion of constant thickness surrounding the helix spiral section of the radiation element and a tapered section surrounding the conical spiral section. The low frequency response was substantially increased with the given diameter in accordance with the formula:

$$\lambda = C/[f(\mu\epsilon)^{\frac{1}{2}}]$$

Where $\lambda$=the wavelength, $\mu$=the magnetic constant, and $\epsilon$=the dielectric constant, f=frequency and C=the speed of light in free space.

An example of the planar spiral/conical spiral/helix antenna fabricated as described above includes a two arm Archimedes planar spiral section having 0.015 inch arm widths and a diameter of 0.390 inches, a two arm equiangular conical spiral section of $\alpha$=60 degrees on 0.020 inch fiberglas substrate having a vertical 1.0 inch height and a four arm helix $\frac{3}{4}$ turn section having a vertical dimension of 0.6 inches. The diameter of the helix supporting cylindrical section is 0.8 inches. The diameter including the external load absorber surrounding the cylindrical section is 1.05 inches and over the conical spiral portion the diameter tapers from the 1.05 inches to the 0.390 diameter of the planar spiral section.

Internally, the air space has a vertical dimension of 0.020 inches followed downwardly by continuously molded sections as follows: SL 22, 0.125 inches thick; SL 24, 0.335 inches thick; SL 26, 0.325 inches thick; and SI 80, 0.700 inches thick. The external load absorber is SI 90, 0.125 inches thick over the helix section and tapering to zero at the planar spiral section.

Figure 4A:
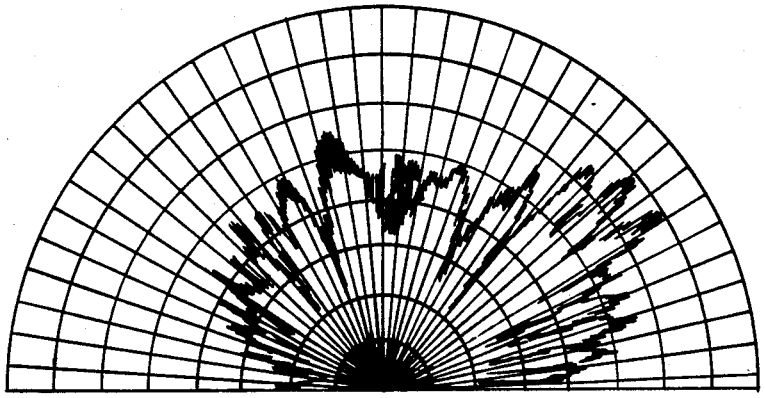
FIGS. 4*a* and 4*b* are views comparing the pattern performance of a planar/spiral antenna element with that of a planar/conical/helix antenna element in a typical aircraft leading edge application.
Figure 4B:
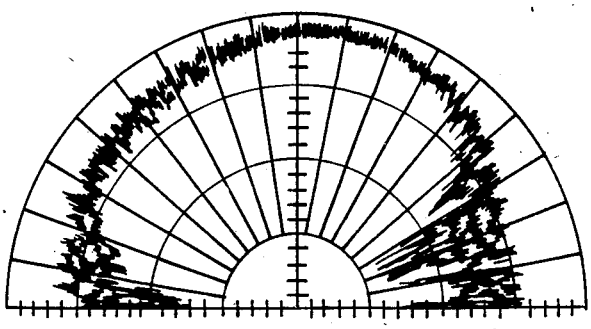

Radiation pattern performance tests of the above example with the antenna element positioned in the leading edge of an aircraft wing resulted in the regular pattern shown in FIG. 4*b*. A comparable planar spiral antenna element positioned in the same leading edge resulted in the irregular pattern shown in FIG. 4*a*. The irregular pattern of FIG. 4*a* is useless for almost any direction finding application; while, the planar/conical/helix pattern of FIG. 4*b* is very suitable for a direction finding system or for an interferometer (tracking) radar such as that discussed by Merrill I. Skolnik, "Introduction to Radar Systems", McGraw-Hill Book Company, 1962, pp 181–184.

The tests further revealed that the four arm termination of the two arm conical antenna together with the magnetic loading of the spiral, both internally and externally, permitted the antenna's diameter to be more than 60% smaller than the planar spiral antenna having the same lower cutoff frequency. In addition the molded SI 90 tapered external load absorber, when molded with a smooth surface as opposed to a rill surface, resulted in improved phase tracking characteristics of the antenna which those persons skilled in the art will appreciate are important considerations in many direction finding system applications.

Although only a single embodiment of the invention has been described, it will be apparent to those skilled in the art that various modifications to the details of construction shown and described may be made without departing from the scope of this invention.

What is claimed is:

1. A broadband antenna comprising:

an RF input;

a support means;

an antenna radiation element means mounted on said support means and electrically connected to the RF input and includes an Archimedes' planar spiral antenna electrically connected to the RF input, a conical spiral antenna electrically connected to the Archimedes' planar spiral antenna and a helix antenna electrically connected to the conical spiral antenna; and internal and external load absorbers internal of and external to the antenna radiation element means whereby said antenna radiation element means and the internal and external load absorbers coact for effectively reducing the size of the broadband antenna.

2. The broadband antenna according to claim 1, wherein the support means includes:

a rigid housing having a hollow interior base section and a centrally disposed upwardly extending tubular section in open communication with the hollow interior base section;

an internal load absorber means lining the interior surfaces of the hollow interior base section;

a coaxial cable connector centrally connected to the rigid housing on the side opposite to the tubular section; and a balun connected between the coaxial cable connector and the Archimedes' planar spiral antenna.

3. The broadband antenna according to claim 2 wherein the means support means comprises a shaped fiberglas substrate fixed to the rigid housing.

4. The broadband antenna according to claim 3 wherein the shaped fiberglas substrate contains the internal load absorber.

5. The broadband antenna according to claim 4 wherein the internal load absorber comprises materials having magnetic loss properties and resistive properties.

6. The broadband antenna according to claim 5 wherein the internal load absorber comprises:

a first part defined by the conical spiral antenna, said first part including a silicone resin body having a plurality of layered regions selectively loaded with carbon particles and micro balloons sufficient to absorb the back lobe radiation of the planar spiral without reflection and to absorb the internal electric fields.

7. The broadband antenna according to claim 6 wherein the internal load absorber includes a second part defined by the helix antenna, said second part being contiguous with the first part and including a silicone resin filled with a preselected amount of iron powder sufficient to improve the low frequency performance of the helix antenna.

8. The broadband antenna according to claim 1 wherein the external load absorber comprises a molded body of materials having a magnetic loss and a high dielectric constant.

9. The broadband antenna according to claim 8 wherein the external molded body includes a cylindrical portion of a preselected thickness in contact with the helix antenna and a tapered portion in contact with the conical spiral antenna.

10. The broadband antenna according to claim 9 wherein the molded body comprises a silicone resin body loaded with iron powder in an amount sufficient for providing substantially improved low frequency performance.

11. The broadband antenna according to claim 9 wherein the tapered portion of the molded body has a smooth exterior.

12. The broadband antenna according to claim 1 wherein the conical spiral antenna has a wrap angle of approximately 60 degrees.

13. A broadband antenna having a unique external profile which is capable of uniform radiation pattern performance in a difficult operating environment such as the leading edge of an aircraft wing and comprises:

an RF input, a support means, an antenna radiation element means mounted on said support means and electrically connected to the RF input and includes an Archimedes' planar spiral antenna electrically connected to the RF input, a conical spiral antenna electrically connected to the Archimedes' planar spiral antenna and a helix antenna electrically connected to the conical spiral antenna.

14. The broadband antenna according to claim 13 wherein the broadband antenna having the unique external profile is loaded with resistive and magnetic loading compounds in such a manner as to make the broadband antenna provide substantially the same electrical performance with the diameter of the antenna radiation element means being physically more that 60% smaller than an antenna radiation element means having equivalent electrical performance and not employing the resistive and magnetic loading compounds.

* * * * *